US010470265B1

(12) United States Patent
Zhao

(10) Patent No.: US 10,470,265 B1
(45) Date of Patent: Nov. 5, 2019

(54) PWM SIGNAL CONTROL CIRCUIT FOR DRIVING CHIP AND LED DRIVING CHIP FOR AUTOMOTIVE READING LAMP

(71) Applicant: Si En Technology (Xiamen) Limited, Xiamen, Fujian (CN)

(72) Inventor: Dongshi Zhao, Xiamen (CN)

(73) Assignee: SI EN TECHNOLOGY (XIAMEN) LIMITED, Xiamen, Fujian (CN)

( * ) Notice: Subject to any disclaimer, the term of this patent is extended or adjusted under 35 U.S.C. 154(b) by 0 days.

(21) Appl. No.: 16/188,141

(22) Filed: Nov. 12, 2018

(51) Int. Cl.
*H05B 33/08* (2006.01)

(52) U.S. Cl.
CPC ..... *H05B 33/0845* (2013.01); *H05B 33/0815* (2013.01)

(58) Field of Classification Search
CPC ..... H05B 33/0845; H05B 33/0815
See application file for complete search history.

(56) References Cited

U.S. PATENT DOCUMENTS 8,786,213 B2 * 7/2014 Yang ..... H05B 33/0848 315/291
9,815,403 B2 * 11/2017 Zhao ..... B60Q 3/76
9,859,909 B1 * 1/2018 Cowan ..... H03M 1/1235

* cited by examiner

*Primary Examiner* — Daniel D Chang
(74) *Attorney, Agent, or Firm* — Leong C. Lei

(57) ABSTRACT

A PWM control circuit for a driving chip and an LED driving chip for an automotive reading lamp are compatible to existing car interior lighting solutions, that is, PWM signals output by MCUs are used to turn on and off LEDs. Also provided is a PWM signal automatically generated within a driving chip and used to control the lighting status of an LED. By using PWM signals generated internally in chips to control LEDs, MCUs can be unburdened from complicated operation, and thereby can operate with improved efficiency.

6 Claims, 5 Drawing Sheets

PWM SIGNAL CONTROL CIRCUIT FOR DRIVING CHIP AND LED DRIVING CHIP FOR AUTOMOTIVE READING LAMP

BACKGROUND OF THE INVENTION

1. Technical Field

The present invention relates to LED driving chips, and more particularly to a PWM control circuit of a driving chip and an LED driving chip for an automotive reading lamp.

2. Description of Related Art

LEDs have been extensively used in automotive lighting systems for their advantages of saving energy and having high efficiency. Nevertheless, in low-and-medium-grade cars, the reading lamps for the first and second rows of seats are still often incandescent bulbs using a tungsten filament as their electric light source.

The brightness of an incandescent lamp is determined by the value of the current passing therethrough. This current value can be calculated by dividing the voltage at the two ends of the incandescent lamp by the equivalent resistance. Since the tungsten filament acting as the light-emitting source of the incandescent lamp has its resistivity increasing with the temperature, the brightness of the incandescent lamp is in turn temperature-dependent. Voltage jitter of batteries can cause jitter of voltage difference between two ends of an incandescent lamp and in turn lead to instable brightness of the incandescent lamp.

In view of this, a China patent application filed on Jan. 13, 2016 by the applicant and later published with an allotted number of CN105578650A, as shown in FIG. 1, discloses an LED driving chip for an automotive reading lamp. The conventional automotive reading lamp uses LEDs instead of incandescent lamps because LEDs are more efficient and power-saving as compared to incandescent bulbs. The conventional LED driving chip turns on or off an LED lamp by having the connected MCU generate a square wave signal related to the variation of the duty ratio. Such a square wave signal is connected to the PWM pin of the LED driving chip, so the chip after receiving the PWM signal can accordingly turn on or off the LED. This means that the MCU is burdened with the work of calculating the variation of the duty ratio of the load, and in turn generate the complicated PWM control signal.

SUMMARY OF THE INVENTION

In order to address the shortcomings of the prior art, the present invention provides a PWM control circuit for a driving chip and an LED driving chip for an automotive reading lamp, which unburdens the MCU in a vehicle.

To achieve the foregoing objectives, the present invention implements the following technical solutions:

A PWM control circuit for a driving chip comprises a dimming-time control circuit module, an internal PWM control circuit module, and a second selector, the dimming-time control circuit module having an input end connected to a TSET_UP pin and a TSET_DN pin of the driving chip, and an output end connected to the internal PWM control circuit module;

the internal PWM control circuit including a synchronous sampling unit, a counter, a Gamma data lookup table, a DFF registering unit, and a PWM signal generator, the synchronous sampling unit having an input end connected to a PWM pin of the driving chip, a reference clock CLK and an output end of the dimming-time control module, the synchronous sampling unit outputting a CLK_UP_SYN signal, a CLK_DN_SYN signal, and a PWM_PIN_SYN signal to an input end of the counter, wherein the PWM_PIN_SYN signal acts as an external PWM signal and is input to an input end of the second selector; the counter having an output end connected to an input end of the Gamma data lookup table, the Gamma data lookup table having an output end connected to an input end of the PWM signal generator through the DFF registering unit, and the reference clock CLK being negated and then connected to the input end of the PWM signal generator; and the PWM signal generator having an output end that outputs an internal PWM signal to another input end of the second selector; and the second selector having a control end connected to a MODE1 pin of the driving chip, and having an output end that outputs an internal PWM signal or an external PWM signal.

When the control end of the second selector inputs a high level, the output end of the second selector outputs the external PWM signal, and when the output end of the second selector input a low level, the output end of the second selector outputs the internal PWM signal.

The dimming-time control circuit comprises a first oscillator and a second oscillator. The first oscillator has an input end connected to the TSET_UP pin of the driving chip and an output end outputting a clock signal CLK_UP to the internal PWM control circuit module. The second oscillator has an input end connected to the TSET_DN pin of the driving chip and an output end outputting the clock signal CLK_DN to the internal PWM control circuit module.

An LED driving chip for an automotive reading lamp comprises a filter detection circuit module, a logic control circuit module, an OUT1/OUT2 reference current setting circuit module, a first current source module, a second current source module, a first selector and the foregoing PWM control circuit, the filter detection circuit module having an input end connected to an EN1 pin and an EN2 pin of the driving chip, a control end connected to a MODE2 pin of the driving chip, and an output end outputting working modes of the EN1 pin and the EN2 pin to the logic control circuit module; when the MODE2 pin inputs a high level, the EN1 pin and the EN2 pin working in a pulse control mode; when the MODE2 pin inputs a low level, the EN1 pin and the EN2 pin working in a level control mode;

the synchronous sampling unit of the PWM control circuit having an input end connected to the PWM pin of the driving chip through the first selector, particularly, the PWM pin of the driving chip being connected to an input end of the first selector, the PWM pin being connected to another input end of the first selector through a negation operator, a POL pin of the driving chip being connected to a control end of the first selector, and an output end of the first selector being connected to an input end of the synchronous sampling unit; when the POL pin inputs a high level, the first selector outputting a PWM signal; and when the POL pin inputs a low level, the first selector outputting a negation signal of PWM;

the logic control circuit module having an input end connected to an output end of the filter detection circuit module, an output end of the second selector of the PWM control circuit, and an output end of the dimming-time control circuit, and the logic control circuit module having an output end connected to an input end of the first current source module and an input end of the second current source module, respectively; and the OUT1/OUT2 reference current setting circuit module having an input end connected to an ISET1 pin and an ISET2 pin of the driving chip, the OUT1/OUT2 reference current setting circuit module having an output end connected to an input end of the first current source module and an input end of the second current source module, the first current source module having an output end connected to an OUT1 pin of the driving chip, and the second current source module having an output end connected to an OUT2 pin of the driving chip.

The driving chip further comprises an OUT3 reference current setting circuit module and an OUT3 current source module, the OUT3 reference current setting circuit module having an input end connected to an ISET3 pin and an EN3 pin of the driving chip, the OUT3 reference current setting circuit module having an output end connected to an input end of the third current source module, and the third current source module having an output end connected to an OUT3 pin.

The driving chip further comprises an abnormality detection circuit module connected to a FAULTB pin, the abnormality detection circuit module comprising a voltage detection circuit, an over-heat protection circuit and an output shout-circuit detection circuit, the abnormality detection circuit module serving to detect whether the driving chip is normal in terms of working voltage and working temperature and whether the driving chip has a shout circuit, and to output an abnormality message to an external circuit through the FAULTB pin when abnormality appears.

With the foregoing technical schemes, the present invention is compatible to existing interior lighting solutions for vehicles, which use PWM signals output by MCUs to turn on and off LEDs. Also provided is a driving chip that automatically generates a PWM signal dim up or dim down LED lighting. When working in the internal PWM signal control mode. The average current of the LED, or the duty ratio of the PWM signal in the internal PWM control mode, varies along a Gamma curve, so that the lighting variation perceived by human eyes is soft and linear. When the driving chip is in the internal PWM control mode, the PWM control signal controlling the LED reading lamp is generated by the internal PWM control circuit module, and this frees the MCU from related calculation, thereby unburdening the MCU and making the MCU operate more efficiently.

Additionally, in the present invention, the EN1 and EN2 pins may be set into the pulse control mode or the level control mode according to practical needs, so that the driving chip is suitable for both touch-switch applications and mechanical-switch applications, thereby enhancing versatility of the driving chip. In the case of a touch switch, it is preferable to set the mode in the pulse control mode, and in the case of a mechanical switch, it is preferable to set the mode in the level control mode.

Moreover, the present invention also enables the basic function of in-car reading lamps, where the lamps is on or off in response to the door-opening and door-closing operations. People in a car can manually set lamps to consistent on or off through a button or a toggle switch control, and there is an indicator lamp to show the current lighting stratus to the user, thereby improving user experience.

DETAILED DESCRIPTION OF THE INVENTION

Figure 1:
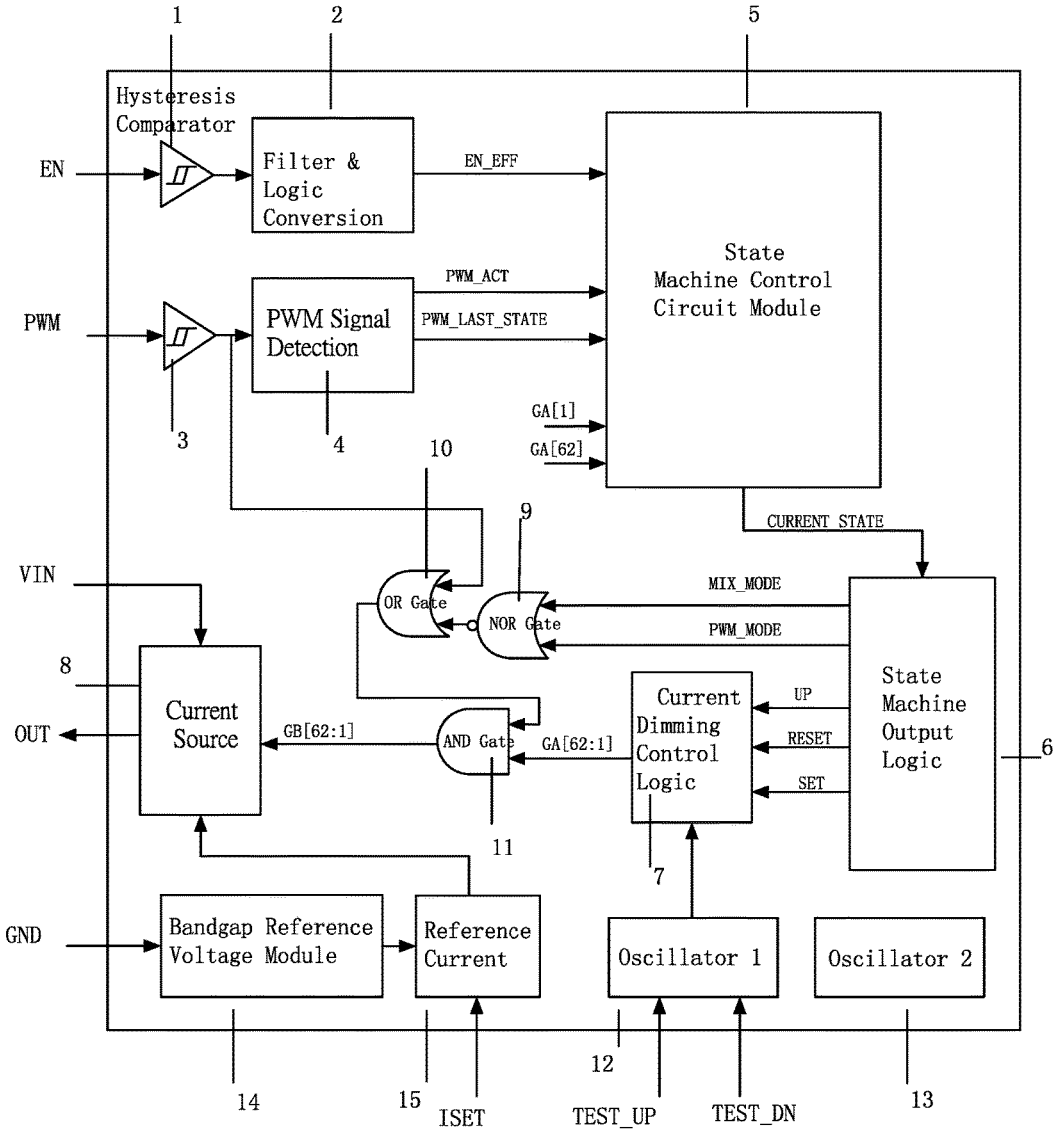
Prior Art FIG. 1
FIG. 1 is a structural diagram of an existing LED driving chip.
Figure 2:
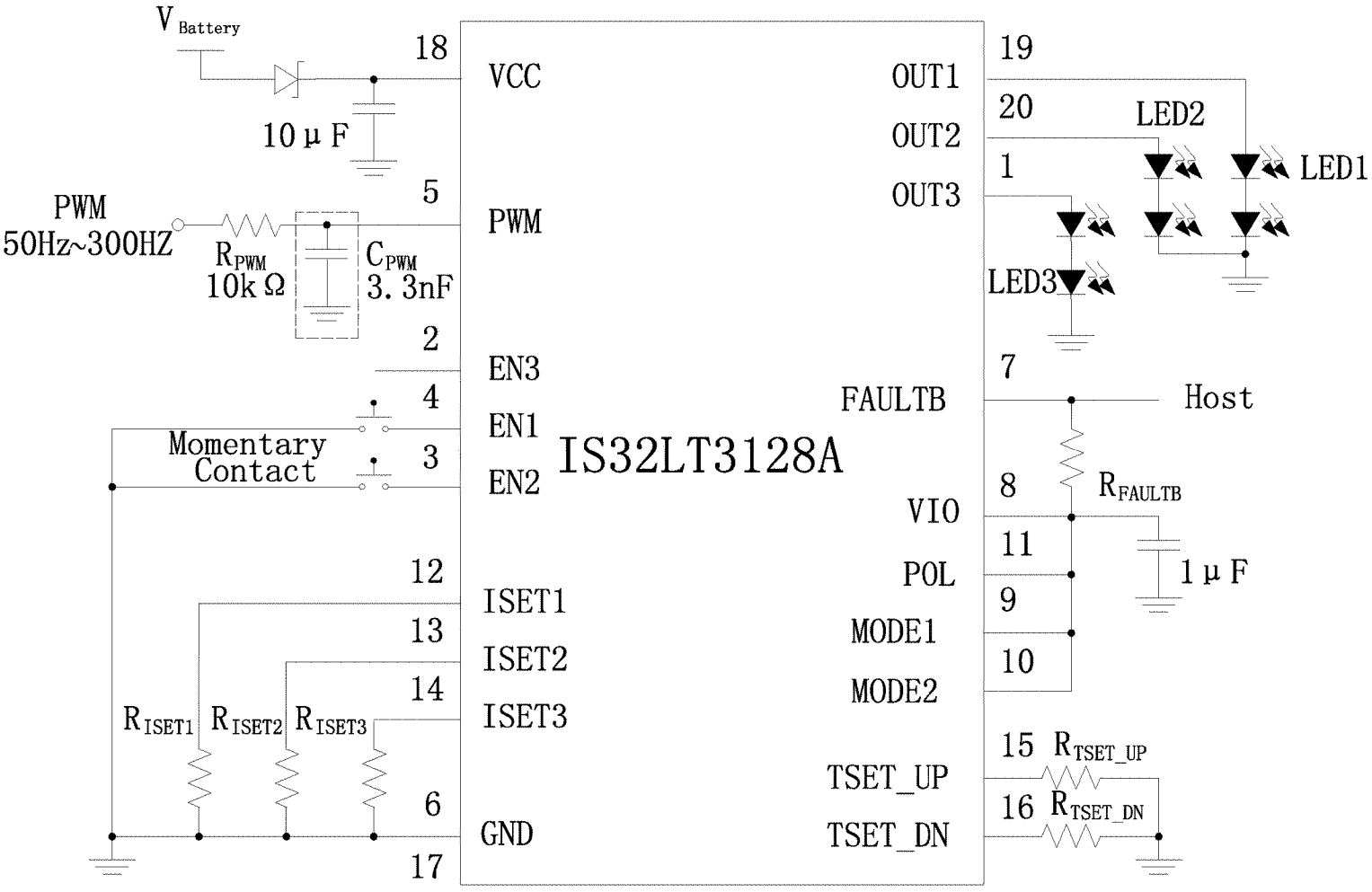
FIG. 2 is an applied diagram of an LED driving chip according to one embodiment of the present invention.

As shown in FIG. 2, the present invention discloses an LED driving chip for an automotive reading lamp, which has 20 pins as shown in Table 1:

TABLE 1

| Pin | Designation | Pin | Designation | Pin | Designation |
|---|---|---|---|---|---|
| 1 | OUT3 | 11 | POL | 15 | TSET_UP |
| 2 | EN3 | 12 | ISET1 | 16 | TSET_DN |
| 3 | EN2 | 13 | IEST2 | 17 | GND |
| 4 | EN1 | 14 | ISET3 | 18 | VCC |
| 5 | PWM | 8 | VIO | 19 | OUT1 |
| 6 | GND | 9 | MODE1 | 20 | OUT2 |
| 7 | FAULTB | 10 | MODE2 | | |

Therein, the VCC pin provides power to the driving chip. The driving chip has a working voltage of 5-40V. The GND pin is a pin where the power source ground wire of the driving chip is connected.

The PWM pin is a pin for inputting a PWM signal. The POL is a pin for inputting a PWM polarity control signal. The MODE1 pin inputs a logic signal for setting how PWM works.

The EN1, EN2, and EN3 pins are input pins to which the OUT1, OUT2, and OUT3 pins output current switch signals, respectively. The MODE2 pin inputs a logic signal for controlling how the EN1 and EN2 pins work.

The ISET1, ISET2, ISET3 pins are pins for setting the output currents of the OUT1, OUT2, and OUT3 pins, respectively.

The TSET_UP pin is the pin to control the dimming-up time of the LED, and connects a resistor to GND. The resistor uses its resistance to control the duration for the LED to dim up. TSET_DN pin is the pin to control the dimming-down time of the LED and connects a resistor to GND. The resistor uses its resistance to control the duration for the LED to dim down.

The OUT1, OUT2, and OUT3 pins are output pins of the driving chip, and are connected to in-car LED reading lamps respectively as loads. The FAULTB pin is an open-drain output pin for outputting abnormality information. The VIO pin is a 5V output pin.

Figure 3:
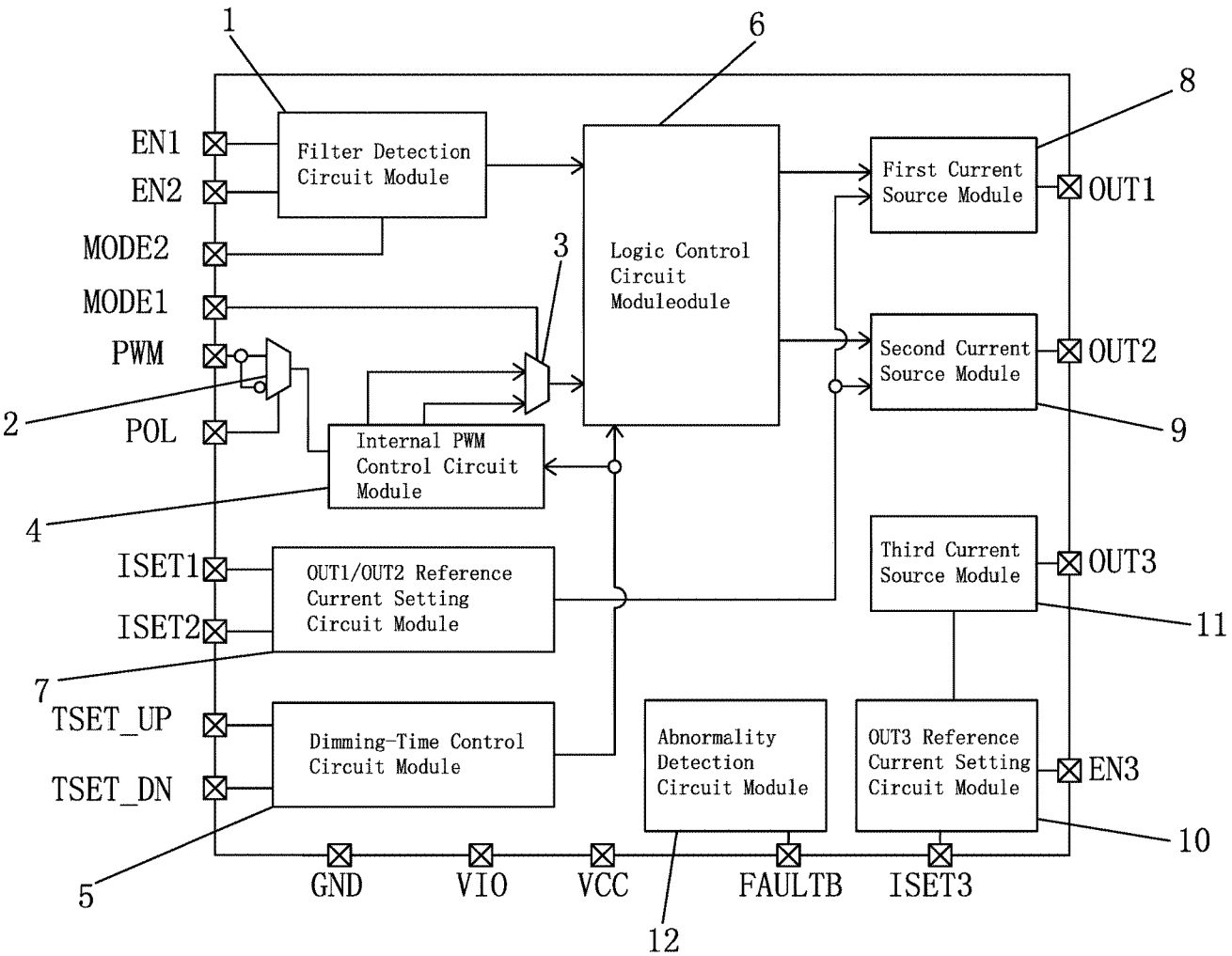
FIG. 3 is a structural diagram of the LED driving chip of the present invention.

The internal structure of the driving chip is shown in FIG. 3. The driving chip comprises a filter detection circuit module 1, a logic control circuit module 6, an OUT1/OUT2 reference current setting circuit module 7, a dimming-time control circuit module 5, a first current source module 8, a second current source module 9, a third current source module 11, an OUT3 reference current setting circuit module 10, an abnormality detection circuit module 12, a first selector 2, a second selector 3, and an internal PWM control circuit module 4.

Wherein, the EN1 and EN2 pins of the driving chip are connected to the input end of the filter detection circuit module 1. The MODE2 pin is connected to the control end of the filter detection circuit module 1. The filter detection circuit module 1 has its output end connected to the logic control circuit module 6. The filter detection circuit module 1 determines how the EN1 and EN2 pins work according to the logic signal input by the MODE2. Particularly, when the MODE2 pin inputs the high level, the EN1 and EN2 pins work in a pulse control mode, and when the MODE2 pin inputs the low level, the EN1 and EN2 pins work in the level control mode.

The PWM pin is connected to an input end of the first selector 2. The PWM pin is connected to another input end of the first selector 2 through a negation operator. The POL pin is connected to the control end of the first selector 2, and the first selector 2 has its output end connected to an input end of the internal PWM control circuit module 4. When the POL pin inputs a high level, the PWM signal input by the PWM pin is active high, so the PWM pin enables current output by inputting the high level, and blocks the output current by inputting the low level. When the POL pin inputs a low level, the PWM signal input by the PWM pin is of the low level, and the PWM signal is active low, so the PWM pin enables current output by inputting the low level, and blocks the output current by inputting the high level.

The TSET_UP and TSET_DN pins of the driving chip are connected to two input ends of the dimming-time control circuit module 5, respectively. The output end of the dimming-time control circuit module 5 outputs clock signals CLK_UP and CLK_DN. Wherein, the frequency of the clock signal CLK_UP determines how fast the LED dims up, and the frequency of the clock signal CLK_DN determines how fast the LED dims down. The output end of the dimming-time control circuit module 5 is connected to the logic control circuit module 6 and is also connected to the internal PWM control circuit module 4 for controlling how fast the duty ratio of the PWM signal changes. To be specific, one cycle of the clock signal output by the dimming-time control circuit module 5 is duration, for which the duty ratio of every step of the PWM signal lasts. The internal PWM signal has its duty ratio gradually increase or decrease in 62 steps.

The internal PWM control circuit module 4 has its input end connected to the output end of the first selector and the output end of the dimming-time control circuit module. The internal PWM control circuit module has its two output ends connected to the two input ends of the second selector, respectively. The second selector has its control end connected to the MODE1 pin, and the second selector has its output end connected to the logic control circuit module. The internal PWM control circuit module 4 outputs the synchronized external PWM signal at its one output end, and outputs the internal PWM signal at its another output end. Depending on the input of the MODE1 pin, the output end of the second selector selectively outputs an external PWM signal or an internal PWM signal. The MODE1 pin inputs a logic signal to determine how PWM is controlled. When the MODE1 pin inputs the high level, it is the external PWM mode, and when the MODE1 pin inputs the low level, it is the internal PWM mode.

When the MODE1 pin inputs the high level, the LED current works in the external PWM signal control mode. In this mode, the PWM pin turns on the LED current by inputting the high level and turn off the LED by inputting the low level.

If the MODE1 pin inputs the low level, the LED current works in the internal PWM signal control mode. In this mode, when the inputs of the PWM pin is at the high level, the LED current is turned on and off with a certain cycle, wherein the on-off frequency is FPWM, and the on duty ratio is D. The duty ratio D increases in the frequency of FUP, so human eyes can see the LED dimming up. When the input of the PWM pin is at the low level, the LED current is turned on and off with a certain cycle, wherein the on-off frequency is FPWM, and the on duty ratio is D. The duty ratio D decreases in the frequency of FDOWN, so human eyes can see the LED dimming down.

An ISET1 pin and an ISET2 pin of the driving chip are connected to the input end of the OUT1/OUT2 reference current setting circuit module 7, and the OUT1/OUT2 reference current setting circuit module 7 is connected to the first current source module 8 and the second current source module 9. The first current source module 8 is connected to the OUT1 pin. The second current source module 9 is connected to the OUT2 pin. The OUT1/OUT2 reference current setting circuit module 7 outputs two reference currents $I_{BIAS1}$, $I_{BIAS2}$, wherein $I_{BIAS1}=V_{REF}/R_{ISET1}$, and $I_{BIAS2}=V_{REF}/R_{ISET2}$. $V_{REF}$ is the internal reference voltage of the chip, and is about 1.2V. $R_{ISET1}$, $R_{ISET2}$ are resistance values of the resistors connected to the $I_{SET1}$ and $I_{SET2}$ pins. The first current source module and the second current source module output current values $I_{OUT1}$ and $I_{OUT2}$, respectively, wherein $I_{OUT1}=I_{BIAS1}*1000$, and $I_{OUT2}=I_{BIAS2}*1000$.

The input end of the logic control circuit module 6 is connected to the output end of the filter detection circuit module 1, the output end of the second selector 3, and the output end of the dimming-time control circuit module 5. An output end of the logic control circuit module 6 is connected to the input end of the first current source module 8. Another output end of the logic control circuit module 6 is connected to the input end of the second current source module 9 The output of the first current source module 8 is short-circuit connected to the OUT1 pin. The output end of the second current source module 9 is connected to the OUT2 pin. The logic control circuit module 6 runs a Mealy machine. The output signal is determined by the present status and the status of all the input signals. The output signal is a digital signal of a high or low level.

The ISET3 and EN3 pins of the driving chip are both connected to the input end of the OUT3 reference current setting circuit module 10, and the output end of the OUT3 reference current setting circuit module 10 is connected to the input end of the third current source module 11, while the third current source module 11 has its output end connected to the OUT3 pin. The OUT3 reference current setting circuit module 10 outputs a reference current $I_{BIAS3}$. $I_{BIAS3}=V_{REF}/R_{ISET3}$. $V_{REF}$ is the internal reference voltage of the chip and is about 1.2V. The third current source outputs a current of $I_{OUT3}$, wherein $I_{OUT3}=I_{BIAS3}*1000$.

The abnormality detection circuit module 12 is connected to the FAULTB pin. The abnormality detection circuit module 12 comprises a voltage detection circuit, an overheat protection circuit and an output shout-circuit detection circuit, for detecting whether the driving chip is normal in terms of working voltage and working temperature and whether the driving chip has a shout circuit, and to output an abnormality message to an external circuit through the FAULTB pin when abnormality appears.

Figure 5:
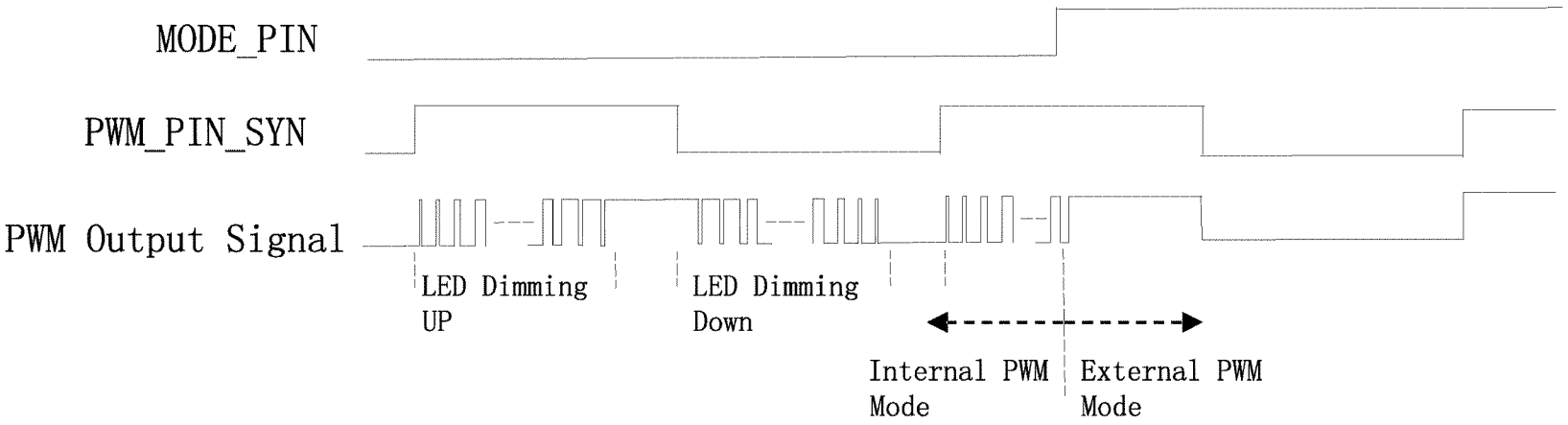
FIG. 5 is a waveform chart of signals output by the PWM control circuit module of the present invention.

FIG. 3 is a block diagram of the PWM control circuit of the driving chip. Referring to FIG. 3 together with FIG. 5, the PWM control circuit comprises a dimming-time control circuit module 5, an internal PWM control circuit module 4, and a second selector 3.

The dimming-time time control circuit module 5 has a first oscillator 51 and a second oscillator 52. The first oscillator 51 has its input end connected to the TSET_UP pin, and outputs a clock signal CLK_UP at its output end. It determines how fast the LED reading lamp dims up. The clock signal CLK_UP is input to the internal PWM control circuit module 4. The input end of the second oscillator 52 is connected to the TSET_DN pin, and the output end of the second oscillator 52 outputs the clock signal CLK_DN. It determines how fast the LED reading lamp dims down. The clock signal CLK_DN is input to the internal PWM control circuit module 4. The resistance values of the resistors connected to the TSET_UP and TSET_DN pins determine the clock cycles of the clocks output by the control first and second oscillators 51, 52. The LED is dimmed up or down by controlling the current to the LED in 62 steps.

During dimming up of the LED and gradual increase of the current powering it, the duration every step lasts is the cycle where the first oscillator 51 outputs the clock. The length of the clock cycle of the first oscillator is determined by the resistance of the resistor connected to the TSET_UP pin. Thus, by changing resistance of the resistor connected to the TSET_UP pin, how long it takes to dim up the LED to its full intensity can be controlled. Similarly, during dimming down of the LED and gradual decrease of the current powering it, the duration every step lasts is the cycle where the second oscillator outputs the clock. The length of the clock cycle of the second oscillator is determined by the resistance of the resistor connected to the TSET_DN pin. Thus, by changing resistance of the resistor connected to the TSET_DN pin, how long it takes to dim down the LED to full darkness can be controlled.

The internal PWM control circuit module 4 comprises a synchronous sampling unit, a counter, a Gamma data lookup table, a 12-bit DFF registering unit, and a PWM signal generator. The synchronous sampling unit is connected to the PWM pin, the reference clock CLK, and the first and second clocks CLK_UP and CLK_DN output by the first and second oscillators. The synchronous sampling unit uses the rising edge of the reference clock CLK to synchronously sample the CLK_UP signal, the CLK_DN signal and the PWM signals, and outputs the synchronously sampled signals CLK_UP_SYN, CLK_DN_SYN, and PWM_PIN_SYN to the counter. Wherein, the synchronous sampling signal PWM_PIN_SYN acting as the external PWM signal is connected to an input end of the second selector.

Particularly, the synchronous sampling signal CLK_UP_SYN is input to the CNT_UP_CLK pin of the counter. The synchronous sampling signal CLK_DN_SYN is input to the CNT_DN_CLK pin of the counter. The synchronous sampling signal PWM_PIN_SYN is input to the UPDN pin of the counter. The count value of the counter may increase or decrease. When the count value increases, UPDN=1, and the count clock uses CNT_UP_CLK. When the count value decreases, UPDN=0, and the count clock uses CNT_DN_CLK. The counter outputs an 8-bit address to control the address of the Gamma data lookup table.

The Gamma data lookup table outputs 12-bit data to the PWM signal generator to control the duty ratio of the PWM signal. The PWM signal generator has a clock CLKB, which is obtained from the reference clock CLK using a negation operator. A 12-bit DFF register is used here to register the 12 bit data of the Gamma data lookup table output. Its clock CLK_UPDATA is synchronous with the falling edge of CLK because the Gamma data lookup table output data and the rising edge of CLK are synchronous. The clock is set in this way to prevent competition and risk of digital signals.

The PWM signal generator generates a square wave clock signal with a duty ratio of D<11:0>, namely the internal PWM signal. At the beginning of every internal PWM signal cycle, the duty ratio data is updated. The PWM signal generator sets an updating duty ratio data clock signal CLK_UPDATA, and inputs the clock signal CLK_UPDATA to the 12-bit DFF register.

Figure 4:
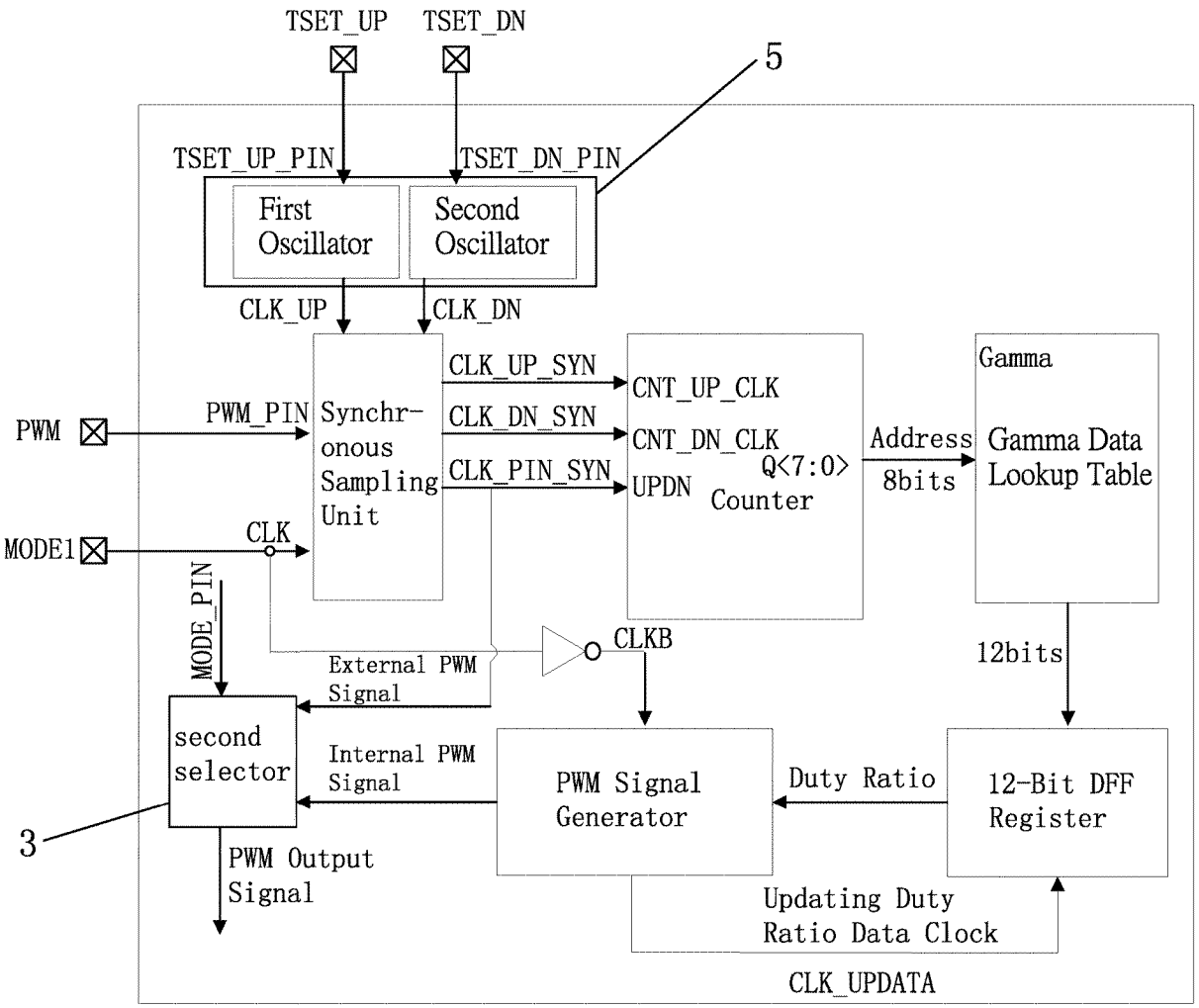
FIG. 4 is a structural diagram of a PWM control circuit module according to one embodiment of the present invention.

The internal PWM signal output by the PWM signal generator is connected to another input end of the second selector, and the control end of the second selector is connected to the MODE1 pin. Depending on that the MODE1 pin inputs the high level or the low level, the second selector outputs an external PWM signal or an internal PWM signal to the logic control circuit module. As shown in FIG. 4, when the MODE1 pin inputs the high level, the second selector outputs an external PWM signal to the logic control circuit module. When the MODE1 pin inputs the low level, the second selector 3 outputs an internal PWM signal to the logic control circuit module 6.

Keeping referring to FIG. 2, the VCC pin is connected to a power source $V_{Battery}$ through a Zener diode. The power source $V_{Battery}$ is connected to the anode of the diode and the VCC pin is connected to the cathode of the diode. Meanwhile, the cathode of the diode is grounded through a 10 F capacitor. The Zener diode and the 10 F capacitor form a voltage regulator circuit for protecting the diode from impacts caused by high currents and high voltages at the moment it is powered on, so as to provide a regulated direct-current voltage and reduce load-impacting currents. The GND pin is the pin for introducing the power source ground wire of the driving chip.

The OUT1 and OUT2 pins are connected to reading lamps LED1 and LED2, respectively. The OUT3 pin is connected to the LED indicator lamp LED3. A car door signal controls on and off of the LED1 and LED2, so that when the car door is open, the LED1 and LED2 dim up, and when the car door is closed, the LED1 and LED2 dim down. The door control signal introduces the PWM signal. Thus, the PWM signal has to control the OUT1 and OUT2 pins. The OUT3 is an indicator lamp for indicating the position of the button, and its lighting status is independent from the door control switch, so OUT3 is not subject to the PWM signal.

The PWM pin introduces a level signal within a certain range through a 10 k resistor $R_{pwm}$. The resistor $R_{pwm}$ is connected to one end of the PWM pin and is grounded through a 3.3 nF capacitor. Herein, the resistor $R_{pwm}$ and the 3.3 nF capacitor form a RC low-pass filter for filtering out high frequency signals.

The EN1 and EN2 pins are grounded through a respective touch switch (for momentary contact). The EN3 pin introduces the logic signal at the high level or at the low level, so as to control the current output of the OUT3 pin. When the EN3 pin inputs the high level, the OUT3 pin allows current output, and when the EN3 pin inputs the low level, the OUT3 pin blocks current output.

The ISET1 pin is grounded through the resistor RISET1. The ISET2 pin is grounded through the resistor RISET2. The ISET3 pin is grounded through the resistor RISET3.

The MODE1, MODE2, and POL pins are all connected to the VIO pin, and the VIO pin outputs a 5V voltage. It is to say that the MODE1, MODE2 and POL pins all introduce the high level.

The TSET_UP and TSET_DN pins are grounded through the resistors RTSET_UP and RTSET_DN, respectively. The resistance of the resistor RTSET_UP determines how fast the LED reading lamp dim up, and the resistance of the resistor RTSET_DN determines how fast the LED reading lamp dim down. The velocities for the LED to dim up and down can be designed separately by using corresponding resistors as the RTSET_UP resistor and the RTSET_DN resistor. Thus, various needs of different users can be easily satisfied by selecting proper resistors.

In the exemplificative application, since the MODE1 and MODE2 pins introduce the high level, the driving chip is in the external PWM control mode. The EN1 pin and the EN2 pin work in a pulse control mode. Every time the touch switch is triggered manually, a low pulse in input to the EN1 and EN2 pins. When the EN1 and EN2 pins receive the low pulse, the present output current of the OUT1 and OUT2 pins is inverted once.

In the event that when the EN1 and EN2 pins receive a low pulse, the OUT1 pin and OUT2 pin are outputting currents, the currents output by the OUT1 and OUT2 pins will to decrease gradually for a coining certain period of time, making the LED dim down. In the event that when the EN1 and EN2 pins are not outputting currents, the currents output by the OUT1 and OUT2 pins will increase gradually for a coining certain period of time, making the LED dim up.

To sum up, with the foregoing technical schemes, the present invention is compatible to existing interior lighting solutions for vehicles, which use PWM signals output by MCUs to turn on and off LEDs. Also provided is a driving chip that automatically generates a PWM signal dim up or dim down LED lighting. When working in the internal PWM signal control mode. The average current of the LED, or the duty ratio of the PWM signal in the internal PWM control mode, varies along a Gamma curve, so that the lighting variation perceived by human eyes is soft and linear. When the driving chip is in the internal PWM control mode, the PWM control signal controlling the LED reading lamp is generated by the internal PWM control circuit module, and this frees the MCU from related calculation, thereby unburdening the MCU and making the MCU operate more efficiently.

Additionally, in the present invention, the control mode of the EN1 and EN2 pins may be set into the pulse control mode or the level control mode according to practical needs, so as to make the chip compatible to applications of touch-switch applications and mechanical-switch applications, thereby improving flexibility of the driving chip. In the case of a touch switch, it is preferable to set the mode in the pulse control mode, and in the case of a mechanical switch, it is preferable to set the mode in the level control mode.

What is claimed is:

1. A PWM control circuit for a driving chip, comprising a dimming-time control circuit module, an internal PWM control circuit module, and a second selector, the dimming-time control circuit module having an input end connected to a TSET_UP pin and a TSET_DN pin of the driving chip, and an output end connected to the internal PWM control circuit module;

the internal PWM control circuit including a synchronous sampling unit, a counter, a Gamma data lookup table, a DFF registering unit, and a PWM signal generator, the synchronous sampling unit having an input end connected to a PWM pin of the driving chip, a reference clock CLK and an output end of the dimming-time control circuit module, the synchronous sampling unit outputting a CLK_UP_SYN signal, a CLK_DN_SYN signal and a PWM_PIN_SYN signal to an input end of the counter, wherein the PWM_PIN_SYN signal acts as an external PWM signal and is input to an input end of the second selector; the counter having an output end connected to an input end of the Gamma data lookup table, the Gamma data lookup table having an output end connected to an input end of the PWM signal generator through the DFF registering unit, and the reference clock CLK being negated and then connected to the input end of the PWM signal generator; and the PWM signal generator having an output end that outputs an internal PWM signal to another input end of the second selector; and the second selector having a control end connected to a MODE1 pin of the driving chip, and having an output end that outputs the internal PWM signal or the external PWM signal.

2. The PWM control circuit of claim 1, wherein when the control end of the second selector inputs a high level, the output end of the second selector outputs the external PWM signal, and when the control end of the second selector input a low level, the output end of the second selector outputs the internal PWM signal.

3. The PWM control circuit of claim 1, wherein the dimming-time control circuit comprises a first oscillator and a second oscillator, the first oscillator has an input end connected to the TSET_UP pin of the driving chip and an output end outputting a clock signal CLK_UP to the internal PWM control circuit module; the second oscillator has an input end connected to the TSET_DN pin of the driving chip and an output end outputting a clock signal CLK_DN to the internal PWM control circuit module.

4. An LED driving chip for an automotive reading lamp, the LED driving chip comprising a filter detection circuit module, a logic control circuit module, an OUT1/OUT2 reference current setting circuit module, a first current source module, a second current source module, a first selector and the internal PWM control circuit of any of claims 1 through 3, the filter detection circuit module having an input end connected to an EN1 pin and an EN2 pin of the LED driving chip, a control end connected to a MODE2 pin of the driving chip, and an output end outputting working modes of the EN1 pin and the EN2 pin to the logic control circuit module; when the MODE2 pin inputs a high level, the EN1 pin and the EN2 pin working in a pulse control mode; when the MODE2 pin inputs a low level, the EN1 pin and the EN2 pin working in a level control mode;

the synchronous sampling unit of the internal PWM control circuit having an input end connected to the PWM pin of the LED driving chip through the first selector, wherein, the PWM pin of the LED driving chip being connected to an input end of the first selector, the PWM pin being connected to another input end of the first selector through a negation operator, a POL pin of the driving chip being connected to a control end of the first selector, and an output end of the first selector being connected to an input end of the synchronous sampling unit; when the POL pin inputs a high level, the first selector outputting a PWM signal; and when the POL pin inputs a low level, the first selector outputting a negation signal of PWM;

the logic control circuit module having an input end connected to an output end of the filter detection circuit module, an output end of the second selector of the internal PWM control circuit, and an output end of the dimming-time control circuit, and the logic control circuit module having an output end connected to an input end of the first current source module and an input end of the second current source module, respectively; and the OUT1/OUT2 reference current setting circuit module having an input end connected to an ISET1 pin and an ISET2 pin of the LED driving chip, the OUT1/OUT2 reference current setting circuit module having an output end connected to an input end of the first current source module and an input end of the second current source module, the first current source module having an output end connected to an OUT1 pin of the driving chip, and the second current source module having an output end connected to an OUT2 pin of the LED driving chip.

5. The LED driving chip of claim 4, wherein the LED driving chip further comprises an OUT3 reference current setting circuit module and a third current source module, the OUT3 reference current setting circuit module having an input end connected to an ISET3 pin and an EN3 pin of the LED driving chip, the OUT3 reference current setting circuit module having an output end connected to an input end of the third current source module, and the third current source module having an output end connected to an OUT3 pin.

6. The LED driving chip of claim 4, wherein the LED driving chip further comprises an abnormality detection circuit module connected to a FAULTB pin, the abnormality detection circuit module serving to detect whether the driving chip is normal in terms of working voltage and working temperature and whether the LED driving chip has a shout circuit, and to output an abnormality message to an external circuit through the FAULTB pin when abnormality appears.

* * * * *